US010586642B2

(12) United States Patent
Kim et al.

(10) Patent No.: US 10,586,642 B2
(45) Date of Patent: Mar. 10, 2020

(54) INDUCTOR FOR INCREASING INDUCTANCE

(71) Applicant: SAMSUNG ELECTRO-MECHANICS CO., LTD., Suwon-Si, Gyeonggi-Do (KR)

(72) Inventors: Jae Hun Kim, Suwon-Si (KR); Eo Jin Choi, Suwon-Si (KR); Young Ku Lyu, Suwon-Si (KR); Yong Hui Li, Suwon-Si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/675,942

(22) Filed: Aug. 14, 2017

(65) Prior Publication Data

US 2018/0174727 A1 Jun. 21, 2018

(30) Foreign Application Priority Data

Dec. 21, 2016 (KR) ..... 10-2016-0176099

(51) Int. Cl.

| | |
|---|---|
| ***H01F 27/29*** | (2006.01) |
| ***H01F 17/00*** | (2006.01) |
| *H01F 17/04* | (2006.01) |

(52) U.S. Cl.

CPC ..... *H01F 17/0006* (2013.01); *H01F 17/0013* (2013.01); *H01F 27/292* (2013.01); (Continued)

(58) Field of Classification Search

CPC ..... H01F 17/0006; H01F 2017/048; H01F 2017/002; H01F 2017/0013; (Continued)

(56) References Cited

U.S. PATENT DOCUMENTS

| | | | |
|---|---|---|---|
| 8,975,997 | B2 | 3/2015 | Tonoyama et al. |
| 9,966,183 | B2 | 5/2018 | Yamauchi et al. |

(Continued)

FOREIGN PATENT DOCUMENTS

| | | | |
|---|---|---|---|
| CN | 103366919 | A | 10/2013 |
| CN | 105453200 | A | 3/2016 |

(Continued)

OTHER PUBLICATIONS

Korean Office Action issued in corresponding Korean Patent Application No. 10-2016-0176099, dated Oct. 30, 2017, with English Translation.

(Continued)

*Primary Examiner* — Mang Tin Bik Lian
(74) *Attorney, Agent, or Firm* — Morgan, Lewis & Bockius LLP

(57) ABSTRACT

An inductor includes a body including a coil, and a support member and external electrodes disposed on an outer surface of the body. The coil may include first and second coils, wherein the first coil does not coincide with a coil mirror-symmetric to the second coil, based on one surface of the body. This is due to the fact that exposure positions of lead portions of the first and second coils exposed to the outer surface of the body are different from each other.

19 Claims, 4 Drawing Sheets

(52) U.S. Cl.
CPC ..... *H01F 2017/002* (2013.01); *H01F 2017/0073* (2013.01); *H01F 2017/048* (2013.01)

(58) Field of Classification Search
CPC ..... H01F 2017/0073; H01F 27/292; H01F 27/2804; H01F 27/29
USPC ..... 336/200, 233, 192
See application file for complete search history.

(56) References Cited

U.S. PATENT DOCUMENTS

| | | | | |
|---|---|---|---|---|
| 2003/0178695 | A1 | 9/2003 | Kamijima | |
| 2008/0100409 | A1 | 5/2008 | Nishikawa et al. | |
| 2013/0222101 | A1 | 8/2013 | Ito et al. | |
| 2013/0249662 | A1* | 9/2013 | Tonoyama | H01F 27/255 336/200 |
| 2016/0133376 | A1* | 5/2016 | Yamauchi | H01F 27/2804 336/192 |

FOREIGN PATENT DOCUMENTS

| | | | | |
|---|---|---|---|---|
| JP | 2001-126923 | A | | 5/2001 |
| JP | 2001126923 | A | * | 5/2001 |
| JP | 2003-282323 | A | | 10/2003 |
| JP | 2008-117851 | A | | 5/2008 |
| JP | 2008-166455 | A | | 7/2008 |
| KR | 10-2013-0049207 | A | | 5/2013 |
| KR | 10-2015-0081802 | A | | 7/2015 |

OTHER PUBLICATIONS

Office Action issued in Chinese Patent Application No. 201710947608.9 dated Aug. 5, 2019, with English translation.

* cited by examiner

INDUCTOR FOR INCREASING INDUCTANCE

CROSS-REFERENCE TO RELATED APPLICATION(S)

This application is based on and claims the benefit of priority to Korean Patent Application No. 10-2016-0176099 filed on Dec. 21, 2016 with the Korean Intellectual Property Office, the entire disclosure of which is incorporated herein by reference.

TECHNICAL FIELD

The present disclosure relates to an inductor and, more particularly, to a power inductor suitable for high inductance and miniaturization.

BACKGROUND

An inductor is a representative passive element configuring an electronic circuit together with a resistor and a capacitor to remove noise. The inductor is combined with a capacitor that uses electromagnetic characteristics to configure a resonance circuit amplifying a signal in a specific frequency band, a filter circuit, or the like.

Recently, as miniaturization and thinness of information technology (IT) devices such as various communications devices, display devices, or the like, has been accelerated, research into technology for miniaturizing and thinning various elements such as an inductor, a capacitor, a transistor, and the like, used in these IT devices has been continuously conducted. Therefore, earlier inductors have been rapidly replaced by inductors having a small size, high density, and capable of being automatically surface-mounted, and a thin film type inductor, in which a mixture of magnetic powders and a resin is formed on coil patterns formed by plating, has been developed.

As a size of the thin film type inductor in which internal coil patterns are formed on upper and lower surfaces of a thin film type insulating substrate as described above is decreased, a volume of the inductor is decreased, a number of turns of the coil is decreased, and a space in which the coil may be formed is decreased. As an area in which the coil is formed is decreased, it is difficult to secure sufficient inductance, thereby decreasing inductance L and a quality factor Q.

A coil device in which a conductor pattern is embedded in a magnetic layer, in order to improve electrical properties while satisfying the requirement for miniaturization and thinness, is disclosed in the following Patent Document 1.

SUMMARY

An aspect of the present disclosure may provide an inductor capable of increasing inductance L without changing a size of the inductor, a raw material, or a manufacturing method.

According to an aspect of the present disclosure, an inductor may include: a body including a coil and a support member; and an external electrode disposed on an outer surface of the body, wherein the coil includes a first coil including a first lead portion and a first connection portion formed at both ends of the first coil, respectively, and a second coil including a second lead portion and a second connection portion formed at both ends of the second coil, respectively, and the external electrode includes a first external electrode connected to the first lead portion, and a second external electrode connected to the second lead portion.

The support member may include a via connecting the first and second coils to each other. The first coil may be disposed on a top surface of the support member, and the second coil may be disposed on a bottom surface of the support member opposing the the top surface of the supporting member.

A first share line may be a virtual line on a first surface of the body, to which the first lead portion is exposed. The first share line may extend from a line shared between the first surface and the top surface of the support member to both ends of the first surface.

A center of the first lead portion may be spaced apart from a central point of the first share line, such that a length of the first coil is longer than a length of a coil wound from the first connection portion to the central point of the first share line.

The second coil may have a mirror-symmetric structure to the first coil with respect to a winding axis of the first coil, except the second lead portion of the second coil.

According to another aspect of the present disclosure, an inductor may include: a body including a coil and a support member; and an external electrode disposed on an outer surface of the body, wherein the coil includes a first coil including a first lead portion and a first connection portion formed at both ends of the first coil, respectively, and a second coil including a second lead portion and a second connection portion formed at both ends of the second coil, respectively, and the external electrode includes a first external electrode connected to the first lead portion and a second external electrode connected to the second lead portion.

The support member may include a via connecting the first and second coils to each other. The first coil may be disposed on a top surface of the support member, and the second coil may be disposed on a bottom surface of the support member opposing the top surface of the support member.

The first coil may be wound in a first winding direction from the first lead portion to the first connection portion and exposed to a first surface of the body.

The second lead portion of the second coil may be exposed to a second surface of the body which is a closest surface to the first surface of the body based on a second winding direction opposite to the first winding direction.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Hereinafter, exemplary embodiments of the present disclosure will be described in detail with reference to the accompanying drawings.

Hereinafter, an inductor according to an exemplary embodiment in the present disclosure will be described, but is not necessarily limited thereto.

Figure 1:
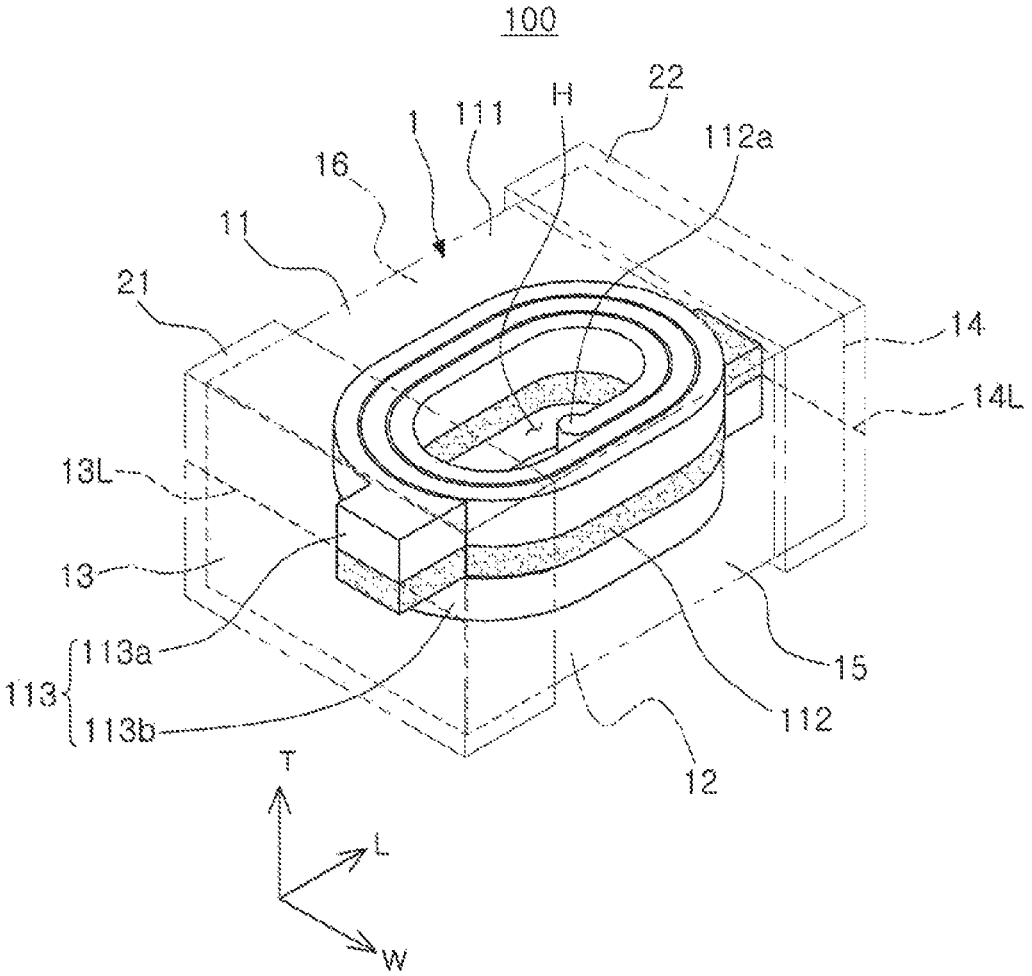
FIG. 1 is a schematic perspective view of an inductor according to an exemplary embodiment in the present disclosure.

FIG. 1 is a schematic perspective view of an inductor according to an exemplary embodiment in the present disclosure.

Referring to FIG. 1, an inductor 100 may include a body 1 and first and second external electrodes 21 and 22 disposed on at least some regions of an outer surface of the body 1.

The body 1 may form an entire exterior of the inductor 100, have upper and lower surfaces 11 and 12 opposing each other in a thickness (T) direction, first and second surfaces 13 and 14 opposing each other in a length (L) direction, and third and fourth surfaces 15 and 16 opposing each other in a width (W) direction, and be substantially a hexahedron. However, the body 1 is not limited thereto.

The body 1 may include an encapsulant 111, and the encapsulant 111 may be included as a structure encapsulating a support member 112 and a coil 113, to be described below. The encapsulant 111 may contain a magnetic material having magnetic properties. For example, the magnetic material in the body 1 may be ferrite or a material in which magnetic metal particles are filled in a resin, wherein the magnetic metal particle may contain one or more selected from the group consisting of iron (Fe), silicon (Si), chromium (Cr), aluminum (Al), and nickel (Ni).

The first and second external electrodes 21 and 22 disposed on at least some regions of the outer surface of the body 1 may have, for example, an alphabet letter C shape, or the like, but specific shapes thereof are not limited. As illustrated in FIG. 1, the first and second external electrodes 21 and 22 may be disposed on the first and second surfaces 13 14 of the body 1, respectively, the first external electrode 21 may be extended from the first surface 13 of the body 1 to some regions of the upper and lower surfaces 11 and 12 and the third and fourth surfaces 15 and 16 of the body 1, and the second external electrode 22 may be extended from the second surface 14 of the body 1 to some regions of the upper and lower surfaces 11 and 12 and the third and fourth surfaces 15 and 16 of the body 1. However, the first and second external electrodes 21 and 22 are not limited thereto.

Since the first and second external electrodes 21 and 22 need to be electrically connected to the coil 113 in the body 1, it is preferable that the first and second external electrodes 21 and 22 contain a material having excellent electrical conductivity, for example, nickel (Ni), copper (Cu), silver (Ag), or an alloy thereof. The first and second external electrodes 21 and 22 may be composed of a plurality of layers. In some cases, after forming a Cu pre-plating layer at an innermost portion, a plurality of plating layers may be disposed thereon. That is, the material and a formation method of the first and second external electrodes 21 and 22 are not limited.

Describing the inside of the body 1, the body 1 may include the encapsulant 111 described above, and further include the support member 112 and the coil 113 encapsulated by the encapsulant 111.

The support member 112 may be able to form a thinner coil more easily, and, in the support member 112, as an insulating resin, a thermosetting resin such as an epoxy resin, a thermoplastic resin such as polyimide, or resins in which a reinforcement material, such as a glass fiber or an inorganic filler, are impregnated in the thermosetting resin and the thermoplastic resin, example materials such as a prepreg, an ajinomoto build-up film (ABF), FR-4, a bismaleimide triazine (BT) resin, a photo imageable dielectric (PID) resin, or the like, may be used. When the glass fiber is contained in the support member 112, rigidity may be more excellent.

A through hole H may be included in a central portion of the support member 112 and filled with the encapsulant 111, thereby forming a central portion of a magnetic core and improving permeability of a coil component.

Next, the coil 113 is supported on upper and lower surfaces of the support member 112. A first coil 113*a* may be supported on the upper surface of the support member 112, and a second coil 113*b* may be supported on the lower surface of the support member 112. The first and second coils 113*a* and 113*b* may be electrically connected to each other by a via 112*a* included in the support member 112, thereby forming a single coil.

The first and second coils 113*a* and 113*b* will be described below with reference to FIG. 2.

Figure 2A:
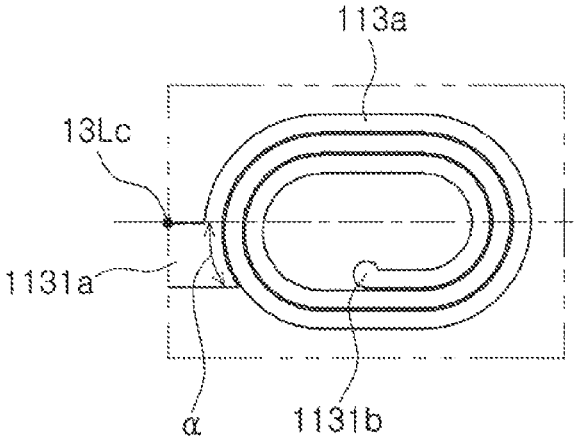
FIGS. 2A and 2B are schematic top views of first and second coils of FIG. 1, respectively.
Figure 2B:
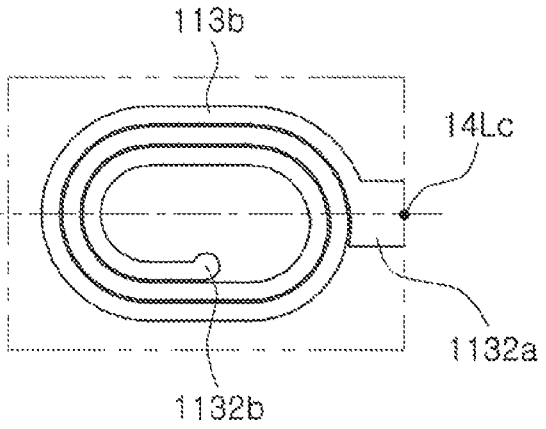

FIG. 2A is a top view of the first coil 113*a* included in the inductor 100 of FIG. 1, and FIG. 2B is a top view of the second coil 113*b* included in the inductor 100 of FIG. 1. Here, the top view illustrates a shape of the coil when viewed from the upper surface 11 of the body 1.

FIG. 2A illustrates the top view of the first coil 113*a*, and the first coil 113*a* may include a first lead portion 1131*a* and a first connection portion 1131*b*.

The first lead portion 1131*a* may be a portion of the first coil 113*a* exposed to the outside of the body 1 through the first surface 13 of the body 1, to electrically connect the first external electrode 21 and the first coil 113*a* to each other.

The first connection portion 1131*b* may be a portion of the first coil 113*a* connected to the via 112*a*, to electrically connect the first and second coils 113*a* and 113*b* to each other.

The first lead portion 1131*a* may be positioned at one end portion of the first coil 113*a*, and the first connection portion 1131*b* may be positioned at the other end portion thereof.

Turning back to FIG. 1, a first share line 13L, at which the first surface 13 of the body 1 and the upper surface of the support member 112 meet each other, may be formed on the first surface 13 of the body 1 to which the first lead portion 1131*a* is exposed. The first share line 13L may be a virtual line and does not mean a line that may be substantially distinguished by the naked eyes.

In other words, the first share line 13L is a virtual line, hypothetically set in order to specify an exposure position of the lead portion of the first coil 113*a*.

A central point of the first share line 13L of FIG. 1 may be indicated by the reference numeral "13Lc" in FIG. 2A. a center of the first lead portion 1131*a* of FIG. 2A may be spaced apart from the central portion 13Lc of the first share line 13L.

In a case in which the center of the first lead portion 1131*a* of FIG. 2A is spaced apart from the central portion 13Lc of the first share line 13L, a winding length of the first coil 113*a* may be increased, as compared to a case in which the center of a first lead portion coincides with the central point of a first share line. As a result, in the inductor 100 according to the present disclosure, inductance of the coil may be increased without changing a size of the inductor 100, a material of the coil, or the like.

FIG. 2B illustrates the top view of the second coil 113*b*, and the second coil 113*b* may include a second lead portion 1132*a* and a second connection portion 1132*b*.

The second lead portion 1132*a* may be a portion of the second coil 113*b* exposed to the outside of the body 1 through the second surface 14 of the body 1, to electrically connect the second external electrode 22 and the second coil 113*b* to each other.

The second connection portion 1132*b* may be a portion of the second coil 113*b* connected to the via 112*a*, to electrically connect the first and second coils 113*a* and 113*b* to each other.

The second lead portion 1132*a* may be positioned at one end portion of the second coil, and the second connection portion 1132*b* may be positioned at the other end portion thereof.

Turning back to FIG. 1, a second share line 14L, at which the second surface 14 of the body 1 and the lower surface of the support member 112 meet each other, may be formed on the second surface 14 of the body 1 to which the second lead portion 1132*a* is exposed. Similar to the first share line 13L, the second share line is a virtual line, hypothetically set in order to specify an exposure position of the lead portion of the second coil 113*b*.

A central point of the second share line 14L of FIG. 1 may be indicated by the reference numeral "14Lc" in FIG. 2*b*. The center of the second lead portion 1132*a* of FIG. 2B may be led to the central portion 14Lc of the second share line.

In this case, when a number of turns of the second coil 113*b* illustrated in FIG. 2B is T, a number of turns of the first coil illustrated in FIG. 2A may be T+α. Therefore, in the coil 13 illustrated in FIG. 1 through FIG. 2B, a number of turns of the entire coil may be increased by +α, as compared to a case in which the lead portions of both the first and second coils 113*a* and 113*b* are exposed in the same manner in the lead portion of the second coil 113*b* illustrated in FIG. 2B. As a result, inductance L of the coil 13 may be increased.

Further, a structure of the second coil 113*b* may not coincide with a structure of a coil that is mirror-symmetric to the first coil 113*a*, based on the second surface 14 of the body 1, which may significantly increase a degree of freedom in pattern design in determining the exposure position of the led portion of the second coil 113*b*. Generally, in a case in which first and second coils are mirror-symmetric to each other, an exposure position of a lead portion of a second coil may be determined, depending on an exposure position of a lead portion of a first coil. On the contrary, the exposure position of the lead portion of the second coil according to the present disclosure may be freely changed regardless of the exposure position of the lead portion of the first coil.

Figure 3A:
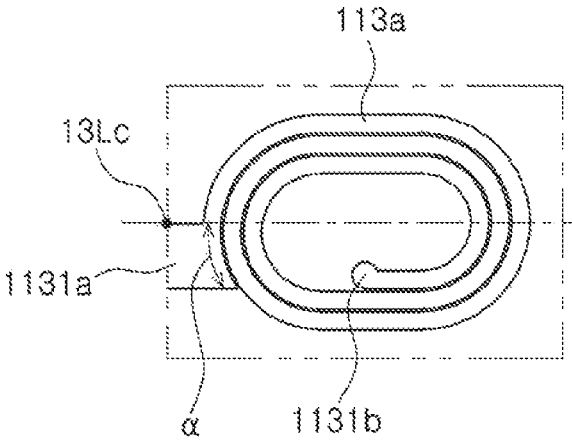
FIGS. 3A and 3B are schematic top views of modified examples of the first and second coils of FIGS. 2A and 2B.
Figure 3B:
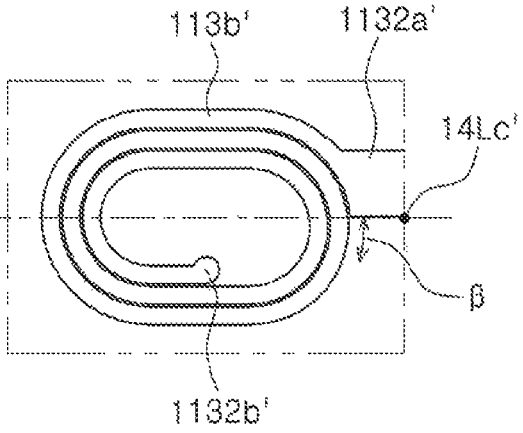

FIGS. 3A and 3B are schematic top views of modified examples of the first and second coils 113*a* and 113*b* of FIGS. 2A and 2B.

A structure of the first coil of FIG. 3A may be completely the same as that of the first coil 113*a* of FIG. 2A, but a structure of the second coil of FIG. 3B is different from that of the second coil 113*b* of FIG. 2B.

For convenience of explanation, the same components of FIGS. 3A and 3B as those in FIGS. 2A and 2B are denoted by the same reference numerals, and an overlapping description of the same components will be omitted.

Since a description of FIG. 3A is completely the same as that of FIG. 2A, the description of FIG. 3A will be omitted.

FIG. 3B illustrates a top view of a second coil 113*b*', and the second coil 113*b*' may include a second lead portion 1132*a*' and a second connection portion 1132*b*'.

When the second lead portion 1132*a*' is exposed to the second surface 14 of the body 1, the center of the second lead portion 1132*a*' may be be spaced apart from a central point 14Lc' of a second share line 14L, at which the second surface 14 of the body 1 and the lower surface 12 of the support member 112 meet each other.

In this case, when a number of turns of the second coil 113*b*' illustrated in FIG. 2B is T, a number of turns of the second coil 113*b*', illustrated in FIG. 3B, may be T−β, which is smaller than T.

Therefore, inductance of the coil illustrated in FIGS. 3A and 3B may be smaller than that of the coil illustrated in FIGS. 1 through 2B.

However, since the number of turns of the first coil 113*a* of FIG. 3A is T+α, which is increased by +α greater? than T, in a case of controlling an absolute value of β to be smaller than an absolute value of a in the number of turns of the second coil 113*b*' of FIG. 3B, that is, T−β, inductance of the inductor 100 may be increased, as compared to a case in which a number of turns of each of the first and second coils 113*a* and 113*b*' is T.

In addition, since a structure of the second coil 113*b*' does not coincide with a structure of a coil that is mirror-symmetric to the first coil 113*a*, based on the second surface 14 of the body 1, a degree of freedom in the design of an exposure position of the lead portion of the second coil in the second surface 14 of the body 1 may be significantly increased.

Figure 4:
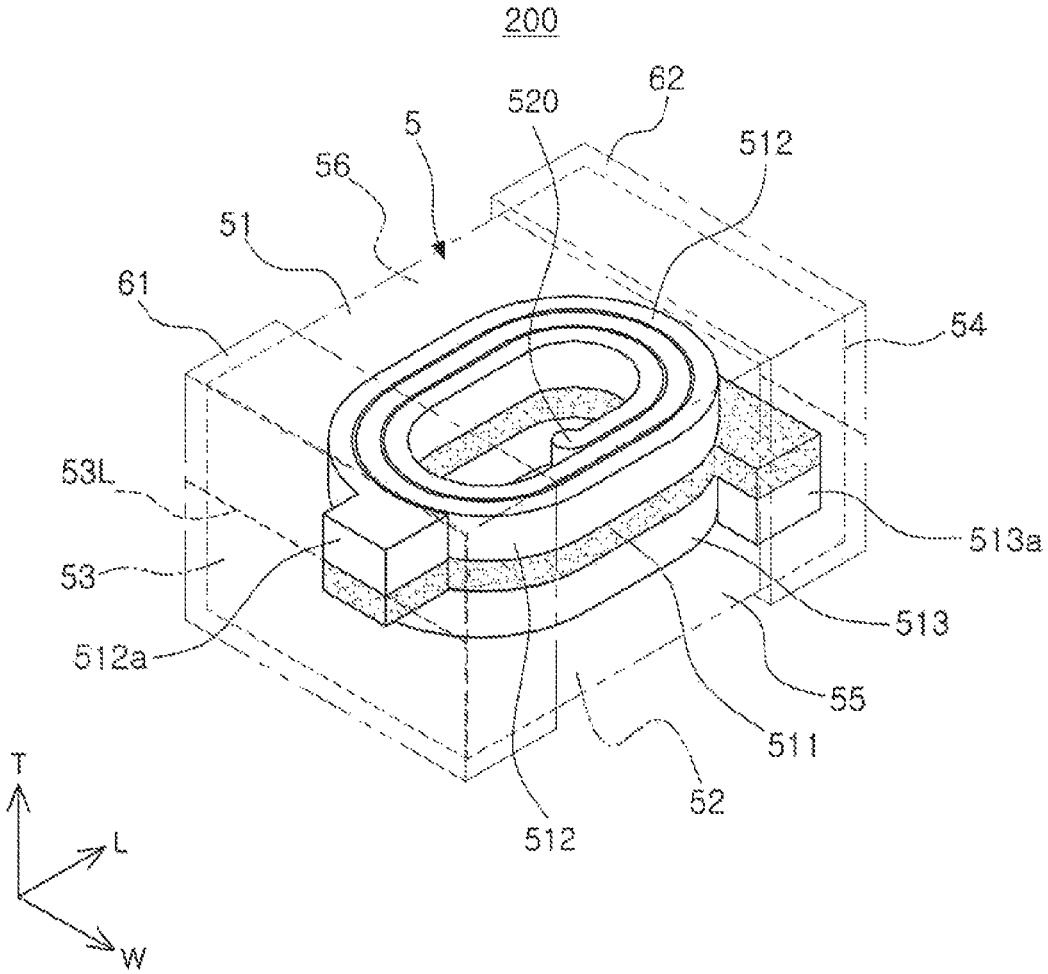
FIG. 4 is a schematic perspective view of an inductor according to another exemplary embodiment in the present disclosure.
Figure 5A:
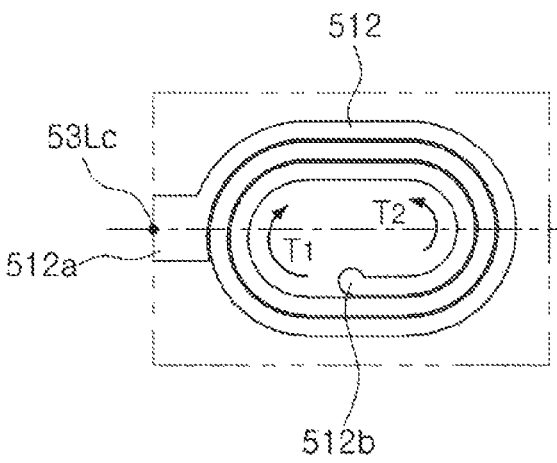
FIGS. 5A and 5B are schematic top views of first and second coils of FIG. 4.
Figure 5B:
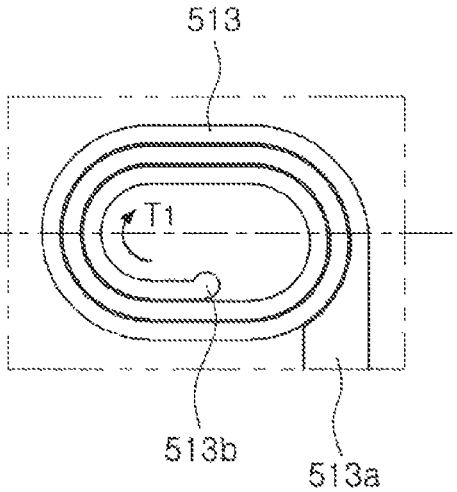

FIG. 4 is a schematic perspective view of an inductor 200 according to another exemplary embodiment in the present disclosure, and FIGS. 5A and 5B are schematic top views of first and second coils 512 and 513 of FIG. 4.

Referring to FIGS. 4 through 5B, the inductor 200 may include a body 5 and first and second external electrodes 61 and 62 disposed on at least some regions of an outer surface of the body 5.

The body 5 may have upper and lower surfaces 51 and 52 opposing each other in a thickness (T) direction, first and second surfaces 53 and 54 opposing each other in a length (L) direction, and third and fourth surfaces 55 and 56 opposing each other in a width (W) direction, but is not limited thereto.

The body 5 may include a support member 511, a first coil 512 supported on an upper surface of the support member 511, and a second coil 513 supported on a lower surface of the support member 511.

The first coil 512 may include a first lead portion 512*a* and a first connection portion 512*b*, and one end portion of the first coil 512 may form the first lead portion 512*a*, connected to the first external electrode 61 and 62, and the other end portion thereof may form the first connection portion 512*b*, connected to the second coil 513 through a via 520. Although not illustrated, one end of the via 520 may be connected to the first connection portion 512*b*, the other end of the via 520 may be connected to a second connection portion, to be described below, and the via 520 may be included in the support member 511.

The first coil 512 may be set to be wound in a first winding direction T1 from the first lead portion 512*a* to the first connection portion 512*b*.

The second coil 513 may include a second lead portion 513*a* and a second connection portion 513*b*, and one end portion of the second coil 513 may form the second lead portion 513*a*, connected to the second external electrode 62, and the other end portion thereof may form the second connection portion 513*b*, connected to the first coil 512 through the via 520.

The second coil 513 may be set to be wound in the first winding direction T1 from the second connection portion 513*b* to the second lead portion 513*a*.

Here, the first winding direction T1 may be the same as a clockwise direction from the top view, a second winding direction T2 may be a counterclockwise direction, and the first and second winding directions T1 and T2 may be opposite to each other. Of course, the first and second winding directions may be relative and may be changed depending on polarities of the first and second external electrodes 61 and 62 connected to the first and second coils 512 and 513, respectively, and are set for convenience for explanation.

Referring to FIG. 4, a first share line 53L, at which the first surface 53 of the body 5 and the upper surface of the support member 511 meet each other, may be formed on the first surface 53 of the body 5 to which the first lead portion 512*a* is exposed. The first share line 53L may be a virtual line introduced for convenience of explanation but does not mean a line that may be substantially distinguished by the naked eyes.

Referring to FIG. 5A, the center of the first lead portion 512*a* may be led to a central point 53Lc of the first share line 53L.

Turning back to FIG. 4, the second lead portion 513*a* may be exposed to the third surface of the body 5, that is, an outer surface of the body 5 closest to the first surface 53 of the body 5 to which the first lead portion 512*a* is exposed in the second winding direction T2, which is the counterclockwise direction. As a result, the second coil 513 may be further wound in the first winding direction T1, which is the winding direction of the second coil 513, as compared to a case in which the second coil 513 is led to the second surface 54 of the body 5, such that inductance of the second coil 513 may be increased. In other words, a winding length of the second coil 513 from the second connection portion to the second lead portion 513*a* may be longer than that of the first coil 512*b* from the first connection portion 512*b* to the first lead portion 512*a*.

In the inductor 200 illustrated in FIGS. 4A through 5B, inductance of the coil may be increased without changing a size of the inductor 200, a material of the coil, or the like.

Figure 6A:
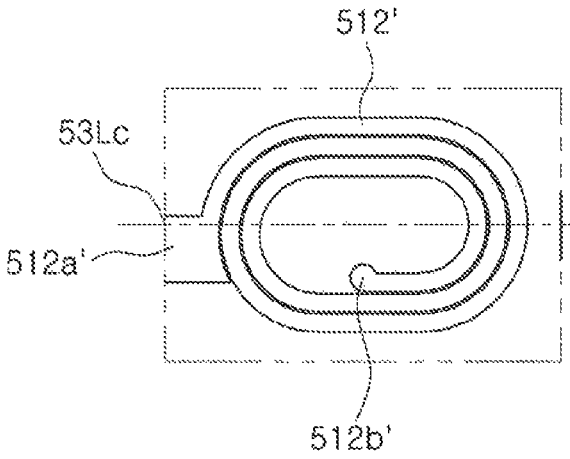
FIGS. 6A and 6B are schematic top views of modified examples of the first and second coils of FIG. 5.
Figure 6B:
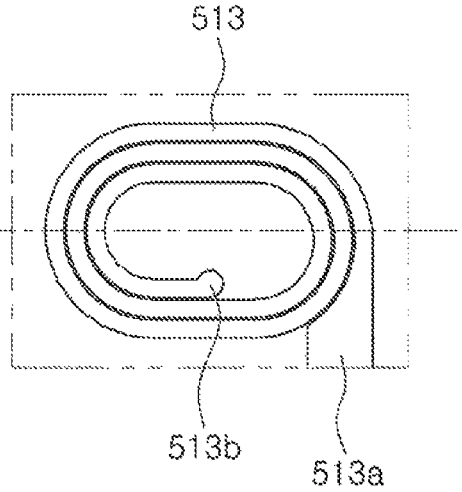

FIGS. 6A and 6B are schematic top views of modified examples of the first and second coils 512 and 513 of FIGS. 5A and 5B, wherein FIG. 6A is a schematic top view of a first coil 512'. FIG. 6B is a schematic top view of the second coil 513.

Since a description of the second coil illustrated in FIG. 6B is the same as that of the second coil illustrated in FIG. 5B, the description of the second coil in FIG. 6B will be omitted.

Referring to FIG. 6A, the first coil 512' may include a first lead portion 512*a*' at one end thereof and a first connection portion 512*b*' at the other end thereof.

The center of the first lead portion 512*a*' may be disposed to be spaced apart from the central point 53Lc of the first share line 53L, at which the first surface 53 of the body 5 and the upper surface of the support member 511 meet each other. Therefore, a winding length of the first coil 512' may be increased as compared to the winding length of the first coil 512 of FIG. 5A, and thus inductance of the coil may be increased.

With the inductors 100 and 200 described above, inductance may be increased by changing the exposure position of the lead portion to increase the winding length of the coil at the same size.

As set forth above, according to exemplary embodiments in the present disclosure, the inductor in which the structure of the lead portion is changed in order to increase the winding length of the coil at the same size to increase inductance may be provided.

While exemplary embodiments have been shown and described above, it will be apparent to those skilled in the art that modifications and variations could be made without departing from the scope of the present invention, as defined by the appended claims.

What is claimed is:

1. An inductor comprising:

a body including a coil and a support member; and an external electrode disposed on an outer surface of the body, wherein the coil includes a first coil including a first lead portion and a first connection portion formed at both end portions of the first coil, respectively, and a second coil including a second lead portion and a second connection portion formed at both end portions of the second coil, respectively, the external electrode includes a first external electrode connected to the first lead portion and a second external electrode connected to the second lead portion, the support member includes a via connecting the first and second coils to each other, the first coil disposed on a top surface of the support member, and the second coil disposed on a bottom surface of the support member opposing the top surface of the support member, a first share line is a virtual line on a first surface of the body, to which the first lead portion is exposed, the first share line extending from a line shared between the first surface and the top surface of the support member to both ends of the first surface, a center of the first lead portion is spaced apart from a central point of the first share line, such that a length of the first coil is longer than a length of a coil wound from the first connection portion to the central point of the first share line, the second coil has a mirror-symmetric structure to the first coil with respect to a winding axis of the first coil, except the second lead portion of the second coil, a winding length of the first coil from the first connection portion to the first lead portion is longer than a winding length of the second coil from the second connection portion to the second lead portion, and a first end of the via is connected to the first connection portion, and a second end of the via is connected to the second connection portion.

2. The inductor of claim 1, wherein the second lead portion is exposed to a second surface of the body opposing the first surface.

3. The inductor of claim 2, wherein a second share line is a virtual line on the second surface of the body, the second share line extending from a line shared between the second surface and the bottom surface of the support member to both ends of the second surface.

4. The inductor of claim 3, wherein a center of the second lead portion coincides with a central point of the second share line.

5. The inductor of claim 3, wherein a center of the second lead portion is spaced apart from a central point of the second share line.

6. The inductor of claim 3, wherein a corner of the first lead portion coincides with the central point of the first share line, and a center of the second lead portion coincides with a central point of the second share line.

7. The inductor of claim 3, wherein a corner of the first lead portion and a corner of the second lead portion coincide with each central point of the first and second share lines, respectively.

8. The inductor of claim 1, wherein the body further includes an encapsulant, containing a magnetic powder, encapsulating the first and second coils and the support member.

9. The inductor of claim 1, wherein the first and second coils have a spiral structure.

10. An inductor comprising:

a body including a coil and a support member; and an external electrode disposed on an outer surface of the body, wherein the coil includes a first coil including a first lead portion and a first connection portion formed at both end portions of the first coil, respectively, and a second coil including a second lead portion and a second connection portion formed at both end portions of the second coil, respectively, the external electrode includes a first external electrode connected to the first lead portion and a second external electrode connected to the second lead portion, the support member includes a via connecting the first and second coils to each other, the first coil disposed on a top surface of the support member, and the second coil disposed on a bottom surface of the support member opposing the top surface of the support member, the first coil is wound in a first winding direction from the first lead portion to the first connection portion and the first lead portion of the first coil is exposed to a first surface of the body, the second lead portion of the second coil is exposed to a second surface of the body which is a closest surface to the first surface of the body based on a second winding direction opposite to the first winding direction, a first share line is a virtual line on the first surface of the body, the first share line extending from a line shared between the first surface and the top surface of the support member to both ends of the first surface, a center of the first lead portion is spaced apart from a central point of the first share line, such that a length of the first coil is longer than a length of a coil wound from the first connection portion to the central point of the first share line, the second coil has a mirror-symmetric structure to the first coil with respect to a winding axis of the first coil, except the second lead portion of the second coil, a winding length of the first coil from the first connection portion to the first lead portion is longer than a winding length of the second coil from the second connection portion to the second lead portion, and a first end of the via is connected to the first connection portion, and a second end of the via is connected to the second connection portion.

11. The inductor of claim 10, wherein a center of the first lead portion coincides with a central point of the first share line.

12. The inductor of claim 10, wherein a center of the first lead portion is spaced apart from a central point of the first share line.

13. The inductor of claim 10, wherein a winding length of the second coil from the second connection portion to the second lead portion is longer than that of the first coil from the first lead portion to the first connection portion.

14. The inductor of claim 10, wherein a first end of the via is connected to the first connection portion, and a second end of the via is connected to the second connection portion.

15. An inductor comprising:

a body including a coil and a support member; and an external electrode disposed on an outer surface of the body, wherein the coil includes a first coil including a first lead portion and a first connection portion formed at both end portions of the first coil, respectively, and a second coil including a second lead portion and a second connection portion formed at both end portions of the second coil, respectively, the external electrode includes a first external electrode connected to the first lead portion and a second external electrode connected to the second lead portion, the support member includes a via connecting the first and second coils to each other, the first coil disposed on a top surface of the support member, and the second coil disposed on a bottom surface of the support member opposing the top surface of the support member, a center of the first lead portion is off a center axis of the first coil, the center axis is in parallel with the top or bottom surface of the supporting member, a winding length of the first coil from the first connection portion to the first lead portion is longer than a winding length of the second coil from the second connection portion to the second lead portion, and a first end of the via is connected to the first connection portion, and a second end of the via is connected to the second connection portion.

16. The inductor of claim 15, wherein the first coil has an extra amount of winding turns, compared to the winding turns of a coil whose lead portion is formed at the center axis of the coil.

17. The inductor of claim 15, wherein the second coil has a mirror-symmetric structure to the first coil with respect to a winding axis of the first coil, except the second lead portion of the second coil.

18. The inductor of claim 15, wherein:

a first share line is a virtual line on a first surface of the body, to which the first lead portion is exposed, the first share line extending from a line shared between the first surface and the top surface of the support member to both ends of the first surface, the second lead portion is exposed to a second surface of the body opposing the first surface, a second share line is a virtual line on the second surface of the body, the second share line extending from a line shared between the second surface and the bottom surface of the support member to both ends of the second surface, and a corner of the first lead portion coincides with the central point of the first share line, and a center of the second lead portion coincides with a central point of the second share line.

19. The inductor of claim 15, wherein:

a first share line is a virtual line on a first surface of the body, to which the first lead portion is exposed, the first share line extending from a line shared between the first surface and the top surface of the support member to both ends of the first surface, the second lead portion is exposed to a second surface of the body opposing the first surface, a second share line is a virtual line on the second surface of the body, the second share line extending from a line shared between the second surface and the bottom surface of the support member to both ends of the second surface, and a corner of the first lead portion and a corner of the second lead portion coincide with each central point of the first and second share lines, respectively.

* * * * *